US005722094A

United States Patent [19]

Ruefer

[11] Patent Number: 5,722,094

[45] Date of Patent: Mar. 3, 1998

[54] INFANT SWADDLING APPARATUS

[76] Inventor: Rebecca U. Ruefer, 1700 Parkview Pl., Bozeman, Mont. 59715

[21] Appl. No.: 747,280

[22] Filed: Nov. 12, 1996

[51] Int. Cl.[6] ..... A41B 13/06

[52] U.S. Cl. ..... 2/69.5; 2/69; 2/83

[58] Field of Search ..... 2/73, 75, 80, 83, 2/69, 69.5, 88, 89

[56] References Cited

U.S. PATENT DOCUMENTS

| | | | |
|---|---|---|---|
| 1,584,853 | 5/1926 | Dern . | |
| 2,538,420 | 1/1951 | Junghans . | |
| 3,034,132 | 5/1962 | Landsberger et al. . | |
| 4,125,903 | 11/1978 | Farrell | 2/69.5 |
| 4,172,300 | 10/1979 | Miller . | |
| 4,255,900 | 3/1981 | Wheeler . | |
| 4,897,885 | 2/1990 | Lunt . | |
| 5,046,204 | 9/1991 | Mohler . | |
| 5,058,226 | 10/1991 | Crosby . | |
| 5,101,513 | 4/1992 | Bowers . | |
| 5,129,406 | 7/1992 | Magnusen et al. | 2/69.5 |

FOREIGN PATENT DOCUMENTS

| | | |
|---|---|---|
| 32557 | 7/1962 | Norway . |

*Primary Examiner*—Jeanette E. Chapman
*Attorney, Agent, or Firm*—Shook, Hardy & Bacon L.L.P.

[57] ABSTRACT

An infant swaddling apparatus is formed of a back panel (16) presenting an upper edge (24), a lower edge (26), and opposed side edges (28, 30) that are tapered toward one another between the upper and lower edges, and a front panel (18) presenting a lower edge (36) and opposed side edges (38, 40) that extend along and are secured to the lower and side edges of the back panel to define a pocket that is closed on the sides and bottom. The front panel (18) also includes an upper edge (42) that is spaced from the upper edge (24) of the back panel (16) in a direction toward the bottom of the pocket, and a hood (32) International Searching Authority secured to the upper edge of the back panel. The length of the pocket is adjustable to accommodate infants of various sizes, and a pair of pieces (46, 48) of hook-and-loop material are provided for this purpose. In addition, other pieces of hook-and-loop material (52, 54) may be provided for closing the pocket around an infant to retain body heat.

7 Claims, 6 Drawing Sheets

INFANT SWADDLING APPARATUS

BACKGROUND OF THE INVENTION

1. Field of the Invention

The present invention relates generally to blankets and swaddling devices for use with newborn infants. More specifically, it relates to products that are used by hospital nursery staff and parents of newborn infants to keep the infants warm during the earliest period of life.

2. Discussion of the Prior Art

The thermoregulatory ability of newborn infants is generally poorly developed. Because the skin and subcutaneous fat layer is very thin and the infant has a high surface area to volume ratio, the infant experiences high rates of heat loss and, frequently, cold stress. This is especially true immediately upon delivery when the infant exits a warm, wet environment and enters a cool, dry (usually air-conditioned) delivery room; newborns typically lose up to 2° F. in core temperature within a few seconds of birth and continue to lose heat until warming measures are undertaken.

In the hospital setting, the most common technique for re-warming an infant immediately after delivery is to place the infant under a radiant warmer. In fact, many hospitals have opted to use these devices routinely for some specified amount of time after every delivery, although the associated expense has limited the use of these warmers in some hospitals to high risk infants in the hospital nursery only. While these devices typically do a satisfactory job of warming the infant, the electric heating element utilizes infrared radiation (IR) which can cause specific problems relating to drying of the infant's skin and general fluid loss. These complications are exacerbated when the infants do not readily regain a normal temperature and have to remain under the radiant warmer for several hours. From the parents' and many professionals' perspective, the most serious drawback to the routine use of radiant warmers immediately after delivery is the necessary separation of the infant from the parents and the inability for physical bonding or early breast-feeding to commence.

More traditionally, garments and blankets have been used in an attempt to limit heat loss in newborn infants. Typically, these devices are supplied by the hospital nursery as a simple, thin cotton-based material in the shape of a rectangular blanket (receiving blanket) which must be folded in a certain preferred manner to prevent heat loss. Often, the untrained person holding the swaddled infant (parents, grandparents, siblings) finds that the blanket has loosened or the infant has worked a foot or hand out such that it no longer keeps the infant warm. This recurring problem necessitates that the hospital staff frequently reswaddle the infant in order to maintain the infant's body temperature and prevent cold stress. An infant swaddled in this manner will generally need some type of hat as well since the head is not securely insulated in this manner.

It is also known that cotton or synthetic single layer garments offer limited insulation qualities. Often, nursery staff personnel are required to double or triple wrap an infant in order to maintain body temperature.

In the Neonatal Intensive Care Unit (NICU), the effects of cold stress are even more restrictive. Most NICU babies are premature at birth and have thermoregulatory abilities which are even less developed than those of full-term infants, and they have thinner (or no) subcutaneous fat layers. Frequently, the parents are unable to hold their newborn for the first several days of life. When they are finally able to hold their infant, they can often do so for only a few minutes at a time before the baby becomes physiologically unstable, partially due to cold stress, and has to be returned to the warming unit (radiant warmer bed or isolette incubator). As the infant grows and becomes more stable, cold stress can delay the transition from the isolette or radiant warmer to the open bed, a necessary step prior to discharge. Or the infant may sustain a normal temperature in the open bed at the expense of weight gain, sometimes even resulting in weight loss. Since most hospitals require infants to attain both a minimum weight and some level of thermal self-regulation prior to discharge, these effects of cold stress can clearly lengthen the hospital stay. For neurological reasons, a few infants continue to demonstrate compromised thermoregulatory abilities even after hospital discharge, sometimes for several weeks, and thus have an ongoing need for supplemental warming and/or insulation.

In recent years, skin-to-skin care, whereby the infant's unclothed body is held directly against the unclothed chest of the mother or father, has been recognized as an efficient way to warm infants without interfering with parental bonding or breast-feeding. This has been particularly advantageous in the NICU setting, as it has been found that NICU infants remain physiologically stable outside of a warmer longer when skin-to-skin care is utilized than when simple receiving blankets are used to wrap the infant prior to the infant being held outside of the warmer. However, even with skin-to-skin care, there is still the problem of heat loss from the head and back surface of the infant and the consequent need for some type of wrap around the back of the infant. In addition, many NICU infants still have various monitoring leads attached to their bodies at this stage of their growth, which can be both cumbersome and intimidating for parents when they are attempting to hold their infants. Finally, skin-to-skin care is not always feasible even when the parents would like to be holding their infant, such as during transport within the hospital (taking the child to x-ray lab or other area for tests, etc.), so the child either has to be transported in an isolette (or other warming device) or forced to deal with cold stress.

OBJECTS AND SUMMARY OF THE INVENTION

It is an object of the present invention to provide an infant swaddling apparatus that can be adjusted to fit and remain snug on infants of various sizes, is easy and convenient to use, and offers a high degree of thermal insulation.

It is another object of the invention to provide an infant swaddling apparatus that can be easily opened to permit skin-to-skin care of an infant while keeping the head and back of the infant covered to limit heat loss.

Yet another object of the invention is to provide an infant swaddling apparatus having a construction which permits a swaddled infant to be placed in a car seat and secured in place without requiring removal or repositioning of the apparatus.

In accordance with these and other objects evident from the following description of a preferred embodiment of the invention, there is provided an infant swaddling apparatus which includes front and back panels that are sewn together to form a pocket within which an infant can be swaddled. The back panel presents an upper edge, a lower edge, and opposed side edges that are tapered toward one another between the upper and lower edges. The front panel presents a lower edge and opposed side edges that extend along and are secured to the lower and side edges of the back panel to define the pocket which is closed on the sides and bottom. The front panel also includes an upper edge that is spaced from the upper edge of the back panel in a direction toward the bottom of the pocket. A hood is secured to the upper edge of the back panel, and preferably includes an elastic band for holding the hood on the head of an infant while the infant is swaddled in the apparatus.

The swaddling apparatus also includes a length adjusting means for adjusting the length of the pocket. The length adjusting means includes a first piece of hook-and-loop material secured to the apparatus adjacent the bottom of the pocket, and a second piece of hook-and-loop material secured to the front panel, wherein the first and second pieces of material cooperate to adhere together when the bottom of the pocket is folded up over the front panel and the first piece of material is brought into contact with the second piece of material.

A closure means is preferably provided for holding the apparatus closed around an infant, and includes a third piece of hook-and-loop material secured to the apparatus adjacent one of the sides of the pocket, and a fourth piece of hook-and-loop material secured to the back panel. The third and fourth pieces of material cooperate to adhere together when the sides of the pocket are folded in over one another and the third piece of material is brought into contact with the fourth piece of material.

Preferably, the front panel of the apparatus is formed of a width greater than the distance between the side edges of the back panel so that when the front panel is secured to the back panel along the side edges, the front panel fits loosely over the back panel. This construction permits the front panel to be easily pulled down when the apparatus is unfolded to expose the front of the infant for direct skin-to-skin contact with the mother or father, while keeping the head and back of the infant covered to prevent heat loss.

By providing an infant swaddling apparatus in accordance with the present invention, numerous advantages are realized. For example, by providing an apparatus having a back panel that is longer than the front panel and a pocket that is closed on the sides and bottom, it is easy to fit the apparatus over an infant, even when the infant is in a fetal position with its legs drawn up against its chest. In addition, by providing a fixed pocket on the apparatus that is adjustable to various lengths, it is easy and convenient to use the apparatus with infants of various sizes.

BRIEF DESCRIPTION OF THE DRAWING FIGURES

A preferred embodiment of the present invention is described in detail below, with reference to the attached drawing figures, wherein.

DETAILED DESCRIPTION OF THE PREFERRED EMBODIMENT

Figure 1:
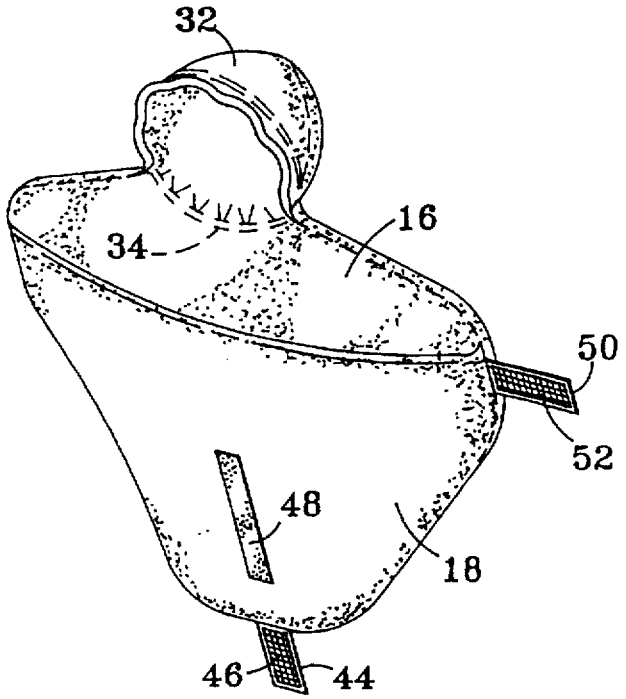
FIG. 1 is a perspective view of an infant swaddling apparatus constructed in accordance with the preferred embodiment.
Figure 14:
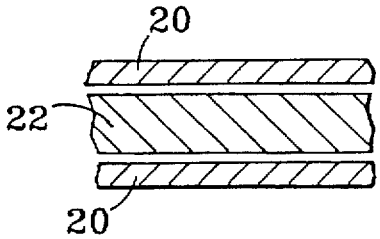
FIG. 14 is a fragmentary cross-sectional view of a fabric used in constructing the apparatus.

An infant swaddling apparatus constructed in accordance with the preferred embodiment is shown in FIG. 1 and broadly includes a pair of panels 16, 18 that are sewn together to form a pocket. Both panels are formed of a multi-layered fabric, shown in FIG. 14, which includes a pair of soft comfortable cotton or synthetic flannel outer layers 20 which come in contact with the infant's skin, and an inner layer 22 of cotton or polyester batting that inhibits the thermoconduction of heat away from the infant's body. Air pockets formed by the layered construction provide "dead air" spaces which add to the overall insulation properties of the device.

Figure 2:
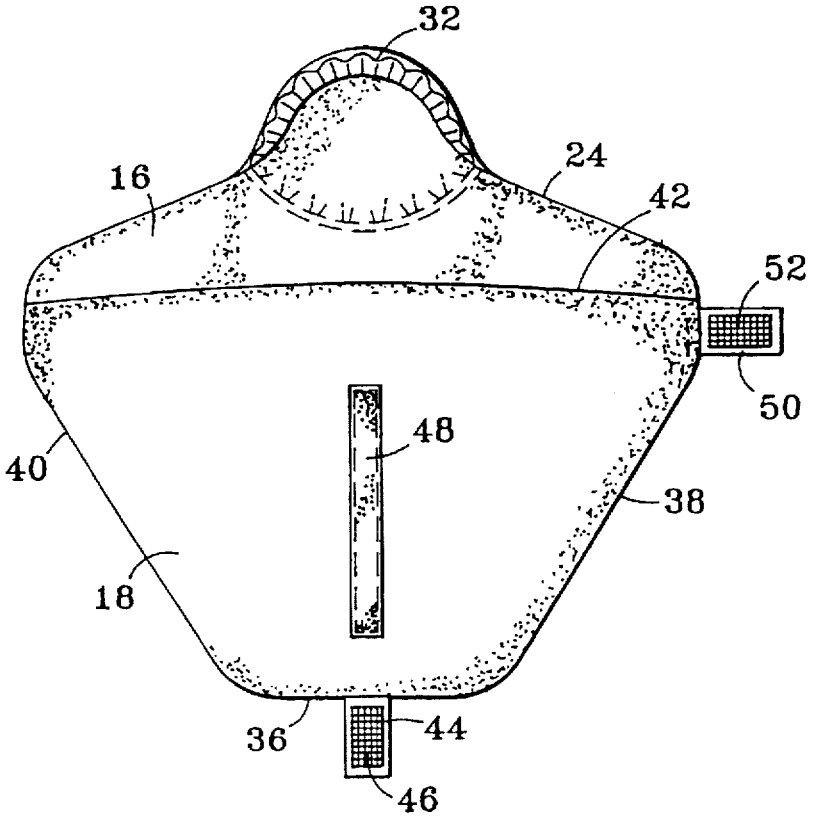
FIG. 2 is a front elevational view thereof.
Figure 3:
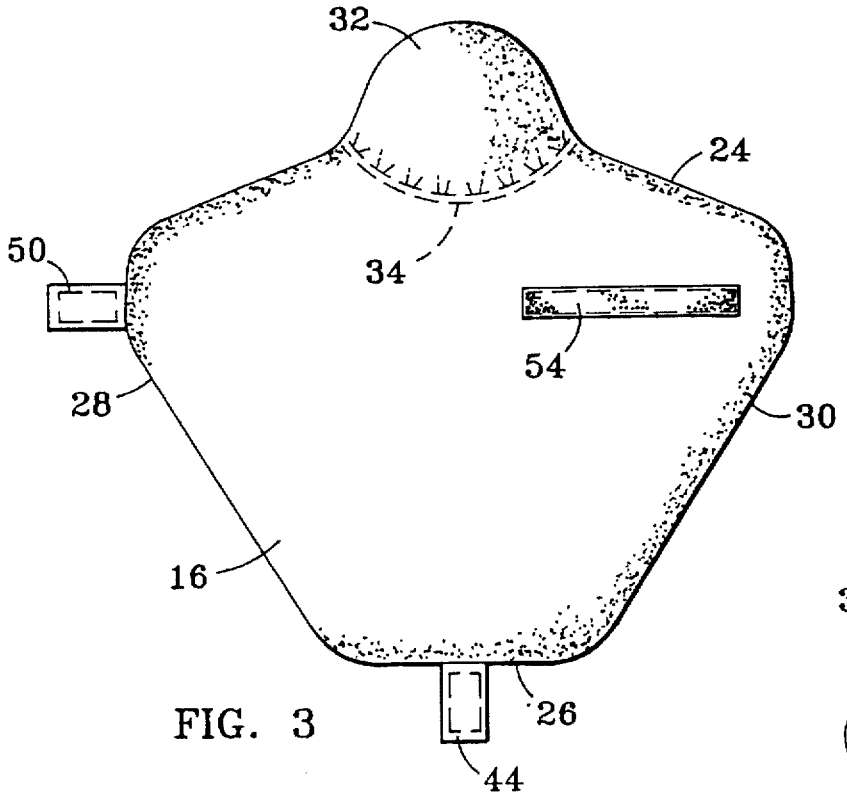
FIG. 3 is a rear elevational view thereof.
Figure 4:
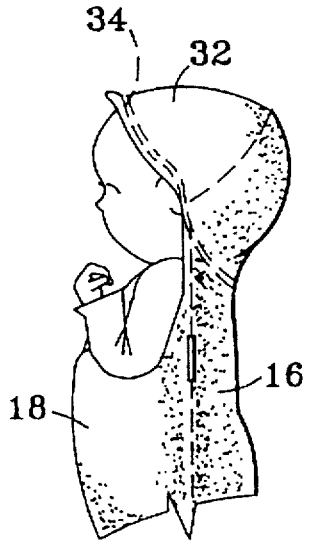
FIG. 4 is a fragmentary side elevational view thereof, illustrating the positioning of an infant within the apparatus.

The back panel 16 is shown in FIG. 3, and is preferably formed of a single piece of fabric, presenting an upper edge 24, a lower edge 26, and opposed side edges 28, 30 that are tapered toward one another between the upper and lower edges. The upper edge 24 tapers upward and inward from each of the side edges toward a central apex at which a hood 32 is formed. The hood is preferably constructed out of the same piece of fabric as the remainder of the back panel, and includes a front edge, shown in FIG. 2, that defines the front of the hood. As shown in FIG. 4, a strip of elastic material 34 is sewn into the hood along the front edge thereof, and along the base of the hood adjacent the upper edge of the back panel. The elastic material permits the hood to be opened for receipt of the infant's head, and holds the hood snugly on the infant's head during swaddling.

Returning to FIG. 3, the lower edge 26 of the back panel is shorter than the upper edge 24, and is aligned centrally with the hood 32. The side edges 28, 30 each include a short, longitudinally extending section adjacent the upper edge of the apparatus, and a tapered section that connects the longitudinally extending section with the lower edge 26 of the back panel.

The front panel 18 is also preferably formed of a single piece of fabric and, and shown in FIG. 2, presents a lower edge 36 and opposed side edges 38, 40 that extend along and are secured to the lower and side edges 26, 28, 30 of the back panel 16 to define a pocket that is closed on the sides and bottom. In addition, the front panel presents a straight, laterally extending upper edge 42 that is spaced from the upper edge 24 of the back panel in a direction toward the bottom of the pocket. Thus, the back panel extends longitudinally beyond the upper edge of the front panel so that it is easy to grip the front panel and open the pocket to position the infant within the apparatus.

The lower edge 36 of the front panel 18 is substantially coextensive with the lower edge 26 of the back panel 16, and the lower edges are sewn together so that the bottom of the pocket is closed. The front panel 18 is preferably formed of a width greater than the distance between the side edges 28, 30 of the back panel so that when the front panel is sewn to the back panel along the side edges, the front panel fits loosely over the back panel. This construction allows the front panel to be pulled down when the apparatus is unfolded, exposing the face and front of the infant so that skin-to-skin care can be given by the mother or father. At the same time, the hood and back panel remain on the infant, preventing heat loss and remaining warm due to continued contact with the infant.

A length adjusting means is provided on the apparatus for adjusting the length of the pocket to accommodate infants of various sizes ranging from as little as 12 inches to well over 20 inches. The length adjusting means includes a strap 44 having a first end that is sewn between the lower edges of the front and back panels, and a second free end depending from the pocket. A first piece 46 of hook and loop material is adhered to the front surface of the strap 44 so that the material faces forward of the apparatus. A second piece 48 of hook and loop material is adhered to the front surface of the front panel 18 so that the material faces forward of the apparatus. Preferably, the first piece 46 is a hook material and the second piece 48 is a loop material, and the two pieces cooperate in a known manner to adhere together when brought into physical contact with one another. The second piece 48 extends from a lower point adjacent the bottom of the pocket to an upper point adjacent the upper edge of the front panel. The first piece of material is much shorter than the second piece, but may be brought into contact with the second piece at any point along the length thereof when the bottom of the pocket is folded up over the front panel. In this manner, the length of the pocket can be adjusted to the length of the infant swaddled therein.

A closure means is provided on the apparatus for holding the apparatus in a closed, folded position around an infant. The closure means includes a strap 50 having a first end that is sewn between the left side edges of the front and back panels, and a second free end protruding beyond the left side of the pocket. A third piece 52 of hook and loop material is adhered to the front surface of the strap so that the material faces forward of the apparatus. A fourth piece 54 of hook and loop material is adhered to the rear surface of the back panel so that the material faces rearward of the apparatus in the unfolded position shown in FIG. 3. Preferably, the third piece 52 is a hook material and the fourth piece 54 is a loop material, and the two pieces cooperate in a known manner to adhere together when brought into physical contact with one another. The fourth piece 54 extends from an outer point adjacent the right side edge of the back panel to an inner point adjacent the central longitudinal axis of the back panel. The third piece 52 is much shorter than the fourth piece, but may be brought into contact with the fourth piece at any point along the length thereof when the right side of the pocket is folded across the front panel and the left side of the pocket is folded up over the right side. In this manner, the apparatus can be can be folded to a closed position and secured against unfolding.

Figure 5:
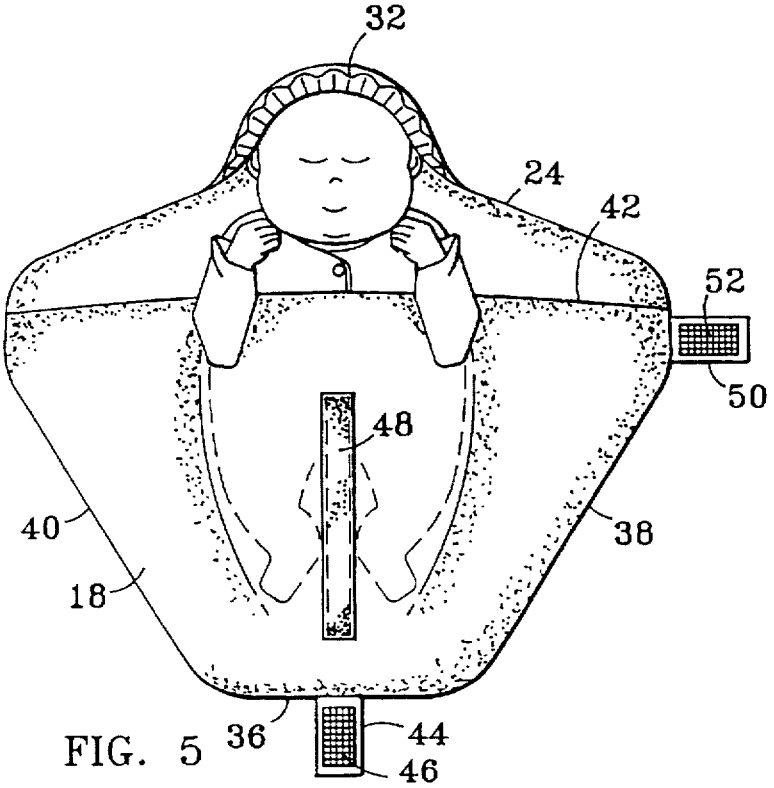
FIG. 5 is a front elevational view thereof, illustrating the positioning of an infant within the apparatus.

In use, the apparatus is laid out in the unfolded position shown in FIG. 5, the front panel 18 is lifted away from the back panel 16, and an infant is positioned within the pocket. Thereafter, the hood 32 is brought up over the infant's head and the front panel is brought up over the infant's chest and under its arms.

Figure 6:
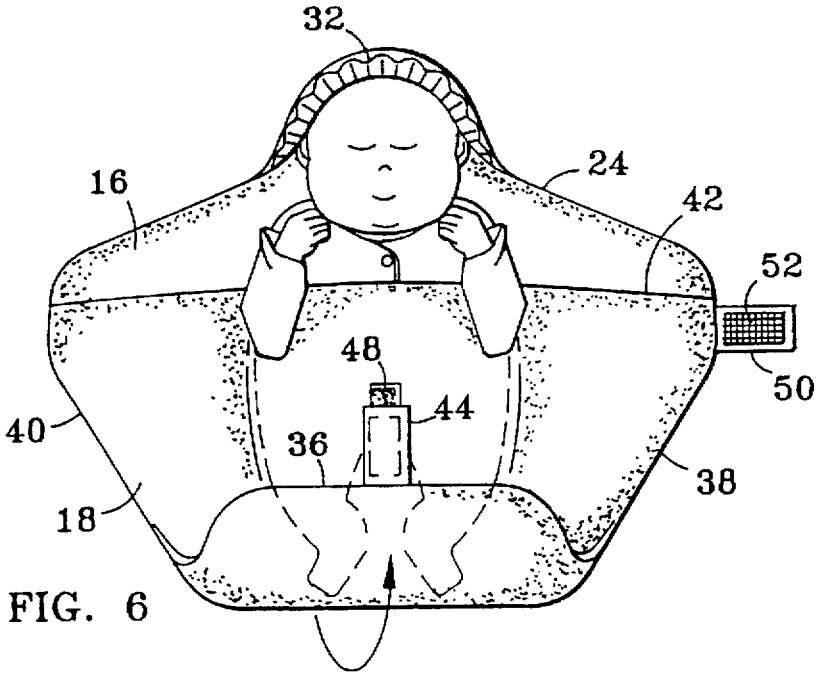
FIG. 6 is a front elevational view thereof, illustrating a folded condition in which the length of the apparatus is shortened.

Once the infant is positioned within the pocket and the hood is in place, the bottom of the pocket is folded up over the front panel, as shown in FIG. 6, in order to adjust the length of the pocket to the length of the infant. Once the length of the pocket is adjusted, the material on the strap 44 is brought into physical contact with the second piece 48 of material on the front panel to secure the folded pocket in place. Thus, the infant is retained within the pocket between the hood and the artificial bottom of the pocket that is formed upon folding thereof.

Figure 7:
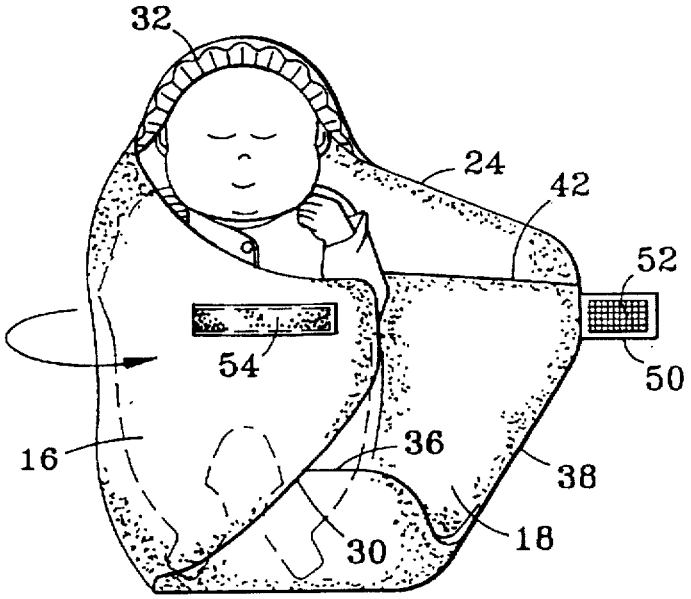
FIG. 7 is a front elevational view thereof, illustrating a partially closed condition of the apparatus.
Figure 8:
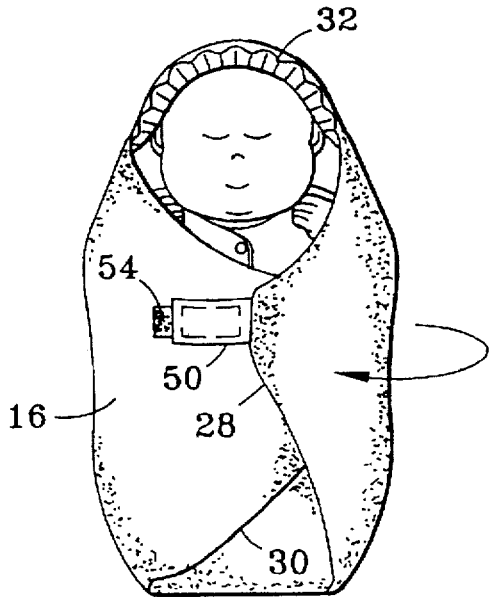
FIG. 8 is front elevational view thereof, illustrating a fully closed condition of the apparatus.

The infant is swaddled within the apparatus by folding the right side of the pocket over the front panel, as shown in FIG. 7, such that the fourth piece 54 of material faces forward of the apparatus. Thereafter, as shown in FIG. 8, the left side of the pocket is folded up over the right side and the third piece 52 of material is brought into physical contact with the fourth piece to secure the apparatus in a closed, folded position.

The apparatus is opened by pulling the third and fourth pieces 52, 54 of material apart from one another, and sequentially unfolding the left and right sides of the pocket to the position shown in FIG. 5. Thereafter, if skin-to-skin care is to be provided, the front panel is pulled away from the infant, exposing the face and front of the infant for contact with the naked chest of the mother or father. At this time, the hood and back panel of the apparatus remain on the infant so that the heat stored within the apparatus is retained. Once this care is completed, the infant is reswaddled while being continuously surrounded by the already warm back panel and hood, reducing the amount of heat loss experienced during and subsequent to such care.

Figure 9:
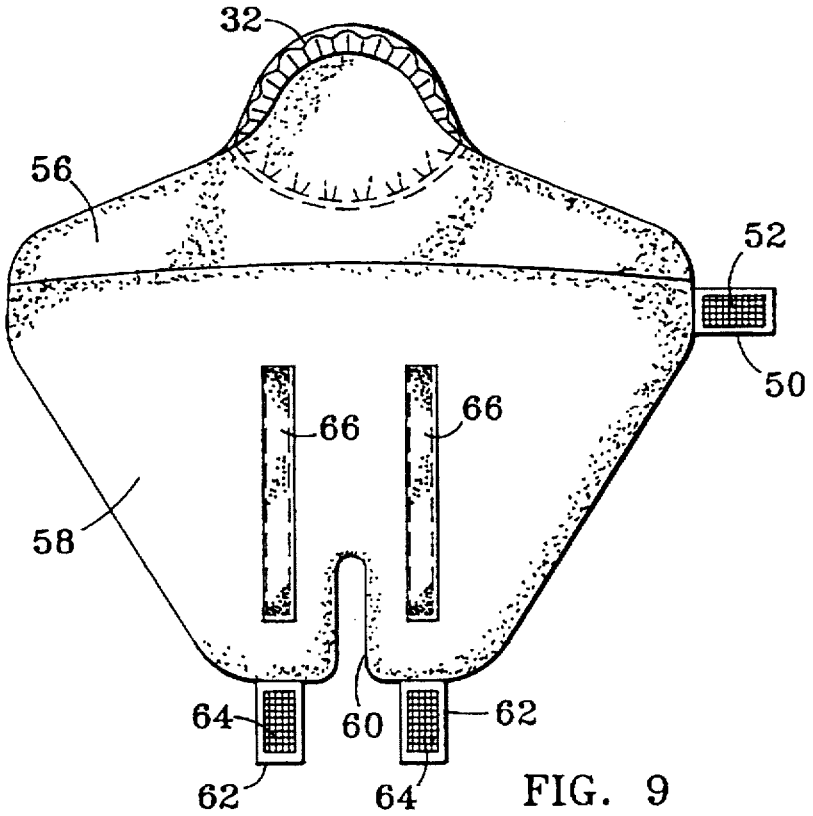
FIG. 9 is a front elevational view of an infant swaddling apparatus constructed in accordance with an alternate aspect of the preferred embodiment.

An alternate embodiment of the apparatus is illustrated in FIGS. 9–13. In the alternate embodiment, as shown in FIG. 9, the front and back panels 56, 58 are each provided with a longitudinally extending slot 60 that is generally aligned with the longitudinal axis of the apparatus. These slots 60 extend upward from the lower edges of the panels in alignment with one another, and the lower edges are sewn together along the length of the slots so that legs are formed in the pocket.

The length adjusting means in the second embodiment includes a pair of straps 62, each having a first end sewn between the lower edges of the panels and a second end depending from the bottom of the pocket. A piece 64 of hook and loop material is adhered to the front surface of each strap, and a second piece 66 of hook and loop material is adhered to the front surface of the front panel in alignment with each strap. The pieces 66 are substantially longer than the pieces 64 so that the bottoms of the legs can be drawn up to any desired length and secured in place to accommodate infants of various lengths.

Figure 10:
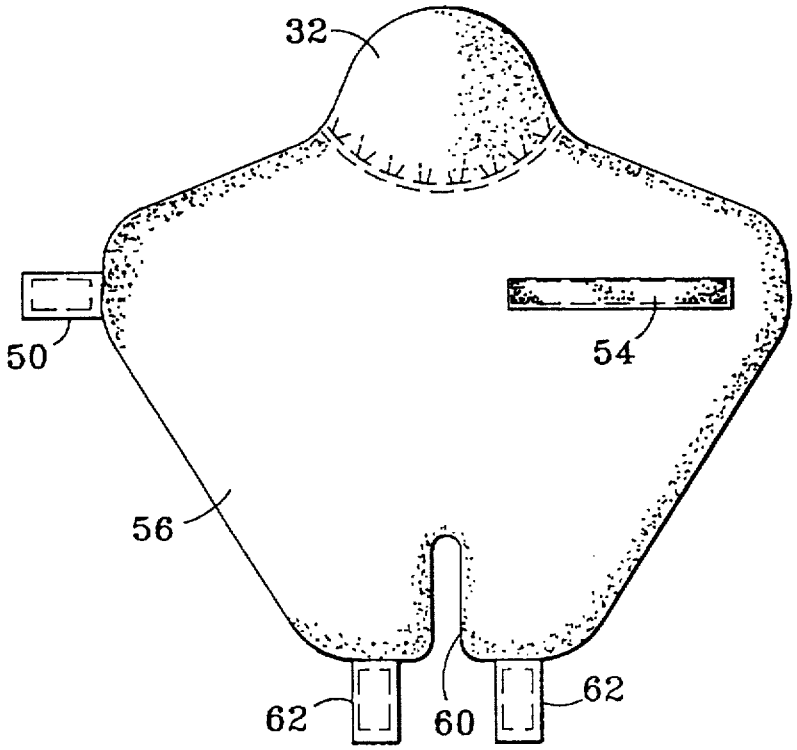
FIG. 10 is a rear elevational view of the alternate embodiment.
Figure 11:
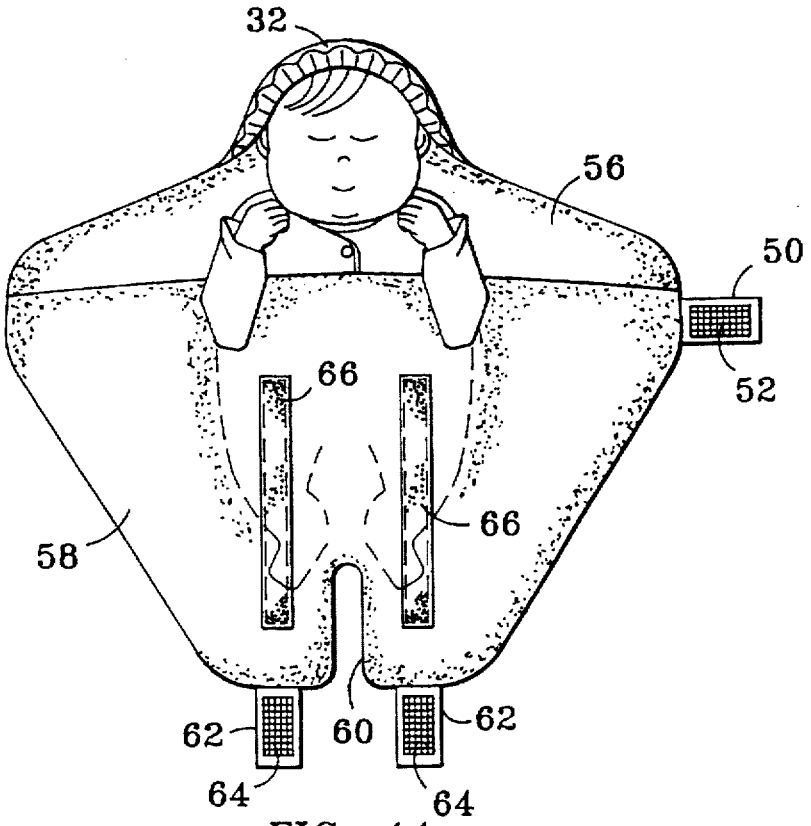
FIG. 11 is a front elevational view of the alternate embodiment, illustrating the positioning of an infant within the apparatus.
Figure 12:
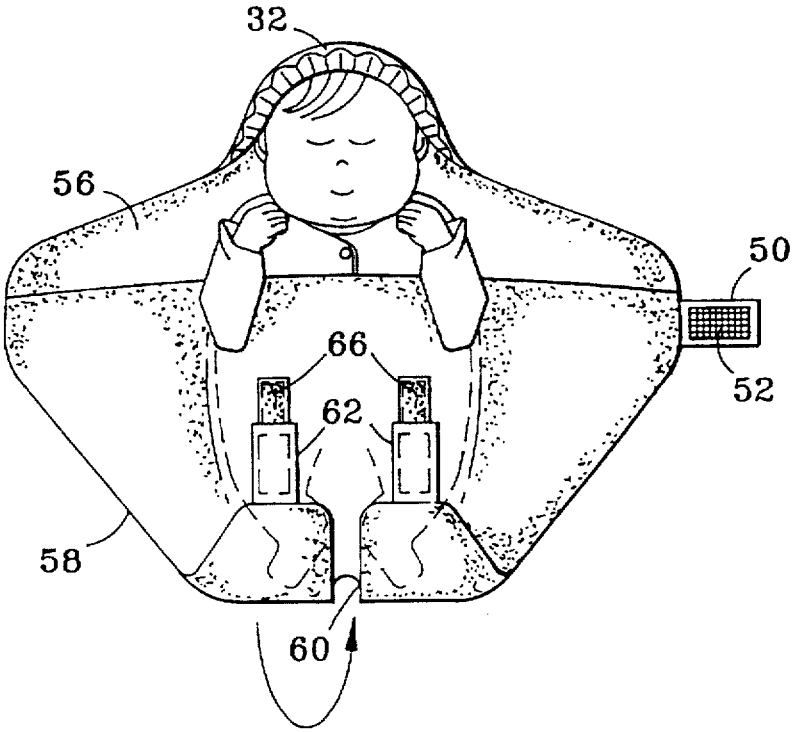
FIG. 12 is a front elevational view of the alternate embodiment, illustrating a folded condition in which the length of the apparatus is shortened.
Figure 13:
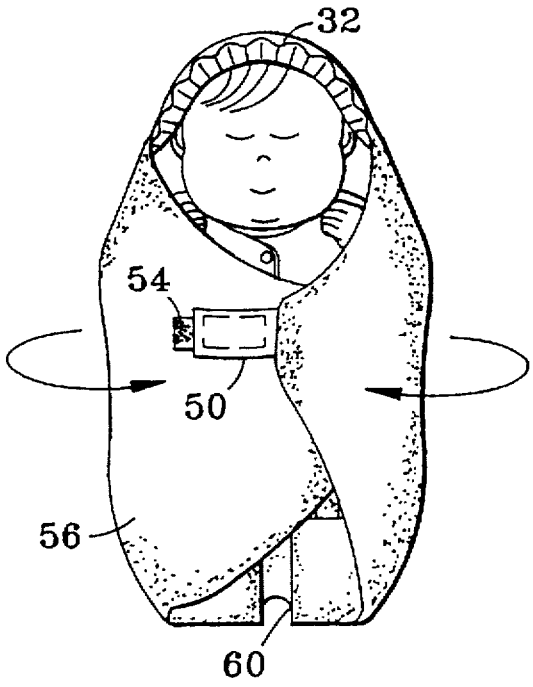
FIG. 13 is a front elevational view of the alternate embodiment, illustrating a fully closed condition of the apparatus.

As shown in FIG. 10, the closure means in the alternate embodiment is identical to the closure means described above, and use of the apparatus is similar to the use described above in that once the infant is positioned in the pocket, as shown in FIG. 11, the length of the pocket is adjusted to accommodate the length of the infant by folding the bottoms of the legs up over the front panel 58 and securing the pieces 64, 66 of material together. Thereafter, swaddling is completed by folding the right side of the pocket over the front panel and the left side of the pocket up over the right side, bringing the pieces 52, 54 of material into contact with one another to hold the apparatus in the folded position.

By providing the slots 60 in the panels 56, 58 such that legs are formed in the pocket, the apparatus is adapted for receipt in a conventional infant car seat of the type provided with a strap that fastens between the legs of the infant. Thus, the apparatus swaddles the infant while allowing the infant to be secured within the car seat, and it is not necessary to unfold or re-fold the apparatus in order to position the infant in or remove it from the car seat.

Although the present invention has been described with reference to the preferred embodiment, it is noted that equivalents may be employed and substitution made herein without departing from the scope of the invention as recited in the claims.

What is claimed is:

1. An infant swaddling apparatus comprising:

a back panel presenting an upper edge, a lower edge, and opposed side edges that are tapered toward one another between the upper and lower edges;

a front panel presenting a lower edge and opposed side edges that extend along and are secured to the lower and side edges of the back panel to define a pocket that is closed on the sides and bottom, the front panel including an upper edge that is spaced from the upper edge of the back panel in a direction toward the bottom of the pocket;

a hood secured to the upper edge of the back panel; and a length adjusting means for adjusting the length of the pocket, the length adjusting means including a first piece of hook-and-loop material secured to the apparatus adjacent the bottom of the pocket, and a second piece of hook-and-loop material secured to the front panel, the first and second pieces of material cooperating to adhere together when the bottom of the pocket is folded up over the front panel and the first piece of material is brought into contact with the second piece of material, the length adjusting means including a strap depending from the bottom of the pocket, the first piece of hook-and loop material being secured to the strap.

2. A swaddling apparatus as recited in claim 1, further comprising a closure means for holding the apparatus closed around an infant, the closure means including a third piece of hook-and-loop material secured to the apparatus adjacent one of the sides of the pocket, and a fourth piece of hook-and-loop material secured to the back panel, the third and fourth pieces of material cooperating to adhere together when the sides of the pocket are folded in over one another and the third piece of material is brought into contact with the fourth piece of material.

3. A swaddling apparatus as recited in claim 1, wherein the front and back panels are each formed of a multi-layered fabric.

4. A swaddling apparatus as recited in claim 3, wherein the fabric includes an inner layer formed of a material selected from the group consisting of cotton batting and synthetic batting, and an outer layer formed of a material selected from the group consisting of cotton flannel and synthetic flannel.

5. A swaddling apparatus as recited in claim 1, wherein the front panel is formed of a width greater than the distance between the side edges of the back panel so that when the front panel is secured to the back panel along the side edges, the front panel fits loosely over the back panel.

6. An infant swaddling apparatus comprising:

a back panel presenting an upper edge, a lower edge, and opposed side edges that are tapered toward one another between the upper and lower edges;

a front panel presenting a lower edge and opposed side edges that extend along and are secured to the lower and side edges of the back panel to define a pocket that is closed on the sides and bottom, the front panel including an upper edge that is spaced from the upper edge of the back panel in a direction toward the bottom of the pocket;

a hood secured to the upper edge of the back panel;

a length adjusting means for adjusting the length of the pocket, the length adjusting means including a first piece of hook-and-loop material secured to the apparatus adjacent the bottom of the pocket, and a second piece of hook-and-loop material secured to the front panel, the first and second pieces of material cooperating to adhere together when the bottom of the pocket is folded up over take front panel and the first piece of material is brought into contact with the second piece of material; and a closure means for holding the apparatus closed around an infant, the closure means including a third piece of hook-and-loop material secured to the apparatus adjacent one of the sides of the pocket, and a fourth piece of hook-and-loop material secured to the back panel, the third and fourth pieces of material cooperating to adhere together when the sides of the pocket are folded in over one another and the third piece of material is brought into contact with the fourth piece of material the closure means including a strap protruding from one of the sides of the pocket, the third piece of hook-and-loop material being secured to the strap.

7. An infant swaddling apparatus comprising:

a back panel presenting an upper edge a lower edge and opposed side edges that are tapered toward one another between the upper and lower edges;

a front panel presenting a lower edge and opposed side edges that extend along and are secured to the lower and side edges of the back panel to define a pocket that is closed on the sides and bottom, the front panel including an upper edge that is spaced from the upper edge of the back panel in a direction toward the bottom of the pocket, the front and back panels including a central slot extending into the panel from the lower edge such that the pocket defined by the panels includes a pair of legs;

a hood secured to the upper edge of the back panel; and a length adjusting means for adjusting the length of the pocket, the length adjusting means including a first piece of hook-and-loop materials secured to the apparatus adjacent the bottom of the pocket, and a second piece of hook-and-loop material secured to the front panel, the first and second pieces of material cooperating to adhere together when the bottom of the pocket is folded up over the front panel and the first piece of material is brought into contact with the second piece of material.

* * * * *